US011192762B2

(12) United States Patent
Kraeutler et al.

(10) Patent No.: US 11,192,762 B2
(45) Date of Patent: Dec. 7, 2021

(54) CRANE WITH OVERLOAD SAFETY DEVICE

(75) Inventors: Wilhelm Kraeutler, Koblach (AT); Eugen Schobesberger, Roethis (AT)

(73) Assignee: LIEBHERR-WERK NENZING GMBH, Nenzing (AT)

( * ) Notice: Subject to any disclaimer, the term of this patent is extended or adjusted under 35 U.S.C. 154(b) by 504 days.

(21) Appl. No.: 13/480,088

(22) Filed: May 24, 2012

(65) Prior Publication Data

US 2012/0298608 A1 Nov. 29, 2012

(30) Foreign Application Priority Data

May 27, 2011 (DE) ..... 10 2011 105 819.6

(51) Int. Cl.
*B66C 23/86* (2006.01)
*B66C 23/94* (2006.01)
*B66C 23/90* (2006.01)

(52) U.S. Cl.
CPC ..... *B66C 23/86* (2013.01); *B66C 23/905* (2013.01); *B66C 23/94* (2013.01)

(58) Field of Classification Search
CPC ..... B66C 13/12; B66C 13/18; B66C 13/20; B66C 15/00; B66C 23/00; B66C 23/52; B66C 23/54; B66C 23/84; B66C 23/86; B66C 23/88; B66C 23/94; B66C 2700/0392; B66C 13/30; B66C 23/905; B66C 15/065
USPC ..... 212/276, 278, 284, 245, 247
See application file for complete search history.

(56) References Cited

U.S. PATENT DOCUMENTS

| | | | | |
|---|---|---|---|---|
| 3,690,387 | A | 9/1972 | Dixon | |
| 3,814,265 | A * | 6/1974 | Miller | 212/276 |
| 4,100,973 | A | 7/1978 | Freudenthal | |
| 5,062,266 | A | 11/1991 | Yoshimatsu | |
| 6,505,574 | B1 | 1/2003 | Naud et al. | |
| 2007/0017889 | A1* | 1/2007 | Schobesberger | B66D 1/58 212/308 |
| 2014/0083965 | A1* | 3/2014 | Mayer | B66C 23/84 212/247 |

FOREIGN PATENT DOCUMENTS

| | | | |
|---|---|---|---|
| DE | 102005034677 | A1 | 2/2007 |
| DE | 102009035197 | A1 | 2/2011 |
| EP | 1052413 | A1 | 11/2000 |
| EP | 2280191 | A2 | 2/2011 |
| WO | 9924730 | A1 | 5/1999 |

* cited by examiner

*Primary Examiner* — Henry Y Liu
*Assistant Examiner* — Juan J Campos, Jr.
(74) *Attorney, Agent, or Firm* — McCoy Russell LLP

(57) ABSTRACT

The present disclosure relates to a crane, in particular an offshore crane, having a slewing gear and a hydraulic slewing gear drive, wherein the slewing gear is held in its position via a holding torque applied by the hydraulic slewing gear drive, and wherein an overload safety device is provided having at least one detection means for detecting the outreach and/or the position of the crane hook and having at least one pressure relief valve, with the system pressure applied to the hydraulic slewing gear drive via at least one pressure relief valve can be regulated in dependence on the outreach and/or on the position of the crane hook.

18 Claims, 2 Drawing Sheets

CRANE WITH OVERLOAD SAFETY DEVICE

CROSS REFERENCE TO RELATED APPLICATION

This application claims priority to German Patent Application No. 10 2011 105 819.6, entitled "Crane with Overload Safety Device," filed May 27, 2011, which is hereby incorporated by reference in its entirety for all purposes.

TECHNICAL FIELD

The present disclosure relates to a crane, in particular an offshore crane, having a slewing gear and a hydraulic slewing gear drive, wherein the slewing gear is held in its position via a holding torque applied by the hydraulic slewing gear drive.

BACKGROUND AND SUMMARY

Crane constructions are as a rule designed for a certain maximum permitted load torque. An exceeding of this permitted load torque can result in substantial danger to the boom system as well as to other crane components and can cause permanent damage to the desired crane construction. Cranes therefore usually have an overload safety device which effects a switching off of the crane operation on an exceeding of the permitted forces on the crane construction.

Abrupt variations in the applied load torque which require a special design of the overload safety device can in particular occur with offshore cranes due to the movement profile of the load to be raised, since a mere switching off of the crane drives results in a destruction of the crane construction, particularly in the load cases which occur in offshore operation. The loading and unloading of a ship, which is not carried out with calm waters in a harbor, but at a higher sea state, is particularly dangerous here. If the lifting hook of a crane standing on an offshore platform catches on the supply ship, an overload of the crane occurs if the supply shift drops into a wave trough. The loads which occur would result in a destruction of the crane if the overload safety device only set the actuator units of the crane out of operation. To prevent a destruction of the crane in such cases, the hoist rope must be paid out.

Such overload safety devices, however, only take account of the vertical movement of the load during the crane operation. The load lying on a ship is thus, for example, possibly also moved in the horizontal direction in addition to the vertical movement due to the wave movement of the sea, whereby the ship or the load drifts laterally with respect to the crane. A lateral movement can also effect a dangerous load torque on the crane construction used, in particular on the slewing gear and on the boom.

It is therefore one object of the present disclosure to further develop an overload safety device for a crane while taking account of the problems above.

This object is achieved by a crane, in particular an offshore crane, having a slewing gear and a hydraulic slewing gear drive. The slewing gear drive applies a torque to the crane slewing gear in a manner known per se to effect a rotary movement of the crane about a vertically standing axis of rotation. A holding torque is usually introduced onto the slewing gear by the hydraulic slewing gear drive to hold it fixed in the desired position.

One aspect of the present disclosure now comprises regulating the applied holding torque to prevent an exceeding of the maximum permitted load torque at the slewing gear due to the load movement. If the torque at the slewing gear effected by the load exceeds the set holding torque, this results in a rotary movement of the boom system and in a relief of the total crane structure. The determination of the maximum permitted load torque takes place in dependence on the outreach and/or the position of the crane hook.

The crane provides an overload safety device for this purpose which has at least one sensor or other detection device for detecting the outreach and/or position of the crane hook and at least one pressure relief valve. In accordance with the present disclosure, the overload safety device is designed such that the system pressure applied to the hydraulic slewing gear drive and consequently the resulting holding torque at the slewing gear drive can be regulated via at least one pressure relief valve in dependence on the outreach and/or the position of the crane hook.

The maximum occurring torque at the slewing gear can be limited by the rotary movement, whereby potential damage to the boom can be prevented. For example, an oblique pull of a suspended load results in a rotary movement of the slewing gear if the maximum torque, that is the holding torque determined by the crane slewing gear drive, is exceeded. The holding torque at the slewing gear which can be regulated is in particular reduced in dependence on the outreach and/or on the position of the hook.

Provision can, for example, be made that the holding torque is defined via the pressure setting of a hydraulic pump connected to the system pressure line in the non-opened state of the pressure relief valve or valves. If a reduction of the holding torque at the slewing gear drive is intended on the basis of the outreach and/or position of the hook, the pressure in the system pressure line can be reduced by an at least partial opening of the pressure relief valve or valves. The pressure relief valve or valves is/are optionally arranged to switch a bypass between the high pressure line and the low pressure line to the slewing gear drive in the open state. The degree of opening of the pressure relief valve or valves then determines the throughflow quantity within the bypass and consequently the degree of the pressure reduction in the high-pressure circuit.

In a particularly advantageous embodiment of the present disclosure, the overload safety device includes at least one pressure limiting valve, in particular a pressure limiting valve which can be proportionally controlled. The starting pressure of the pressure limiting valve is in this respect switched as the control pressure to at least one or, optionally, all pressure relief valves. Accordingly, the respective degree of opening of the pressure limiting valve or valves can be adjusted via the pressure limiting valve.

The pressure limiting valve may be made in a variable manner and the overload safety device or the control unit of the overload safety device regulates the starting pressure of the pressure limiting valve and consequently the applied control pressure at at least one pressure relief valve in dependence on the detected outreach and/or on the position of the crane hook. The system pressure and the resulting holding torque at the slewing gear drive can accordingly be regulated via the variable pressure limiting valve in dependence on the detected outreach and/or on the position of the crane hook.

Provision can furthermore be made that the control line of at least one or all pressure relief valves is connected via at least one check valve to the system pressure line of the slewing gear drive. The control line may be connected via at least one check valve to the supply of the system pressure line to the hydraulic slewing gear drive and via at least one check valve to the backflow of the system pressure line.

The hydraulic slewing gear drive may include at least one hydraulic motor for carrying out a rotary movement of the slewing gear drive. It can be expedient that the required holding force at the slewing gear drive is generated by the driving torque of the hydraulic motor. The present disclosure therefore provides a corresponding control of the hydraulic motor via the present system pressure to regulate the applied holding torque in dependence on the outreach and/or on the position of the hook.

Furthermore, a hydraulic locking brake can be provided which applies a corresponding holding torque to the slewing gear drive additionally or alternatively to the hydraulic motor. Independently of the specific design of the slewing gear drive, the overload safety device in accordance with the present disclosure carries out a corresponding regulation of the control pressure to apply the desired holding torque via the slewing gear drive.

It can thus be expedient that a user-defined maximum limit holding torque flows into the control of at least one pressure relief valve in addition to the outreach-dependent and position-dependent regulation of the holding torque. Such a limit value is particularly taken into account in the control of the proportional pressure limiting valve, in one example.

The pressure limiting valve can generally be made and arranged in different manners. Provision can be made that the outlet side of the pressure limiting valve is connected to a tank of the system.

The pressure relief valve or valves can themselves have different designs. In accordance with an advantageous embodiment of the present disclosure, at least one pressure relief valve can be designed as a valve cartridge or as a so-called cartridge valve.

Furthermore, the overload safety device of the crane can include an on/off valve which only activates the overload safety function in the energy-loaded state. In the non-energy loaded state, for example, the pressure relief valve can be blocked in that the pressure line between the pressure limiting valve and the pressure relief valve is blocked.

A path detection device, in particular a switch position monitor or sensor, can be associated with the on/off switch which monitors the switch position of the on/off switch and thus allows fault detection.

The complete overload safety device of the crane is not restricted to the regulation of the holding torque at the slewing gear; however, for reasons of simplicity, reference was only made to this function. The overload safety device can generally measure and monitor further torques and forces at the crane system and optionally likewise control the individual crane drives in a matching manner, such as a regulated control of the hoist winch drive to pay out the hoist rope in the event of overload.

The present disclosure will be explained in more detail in the following with respect to an embodiment and to associated drawings.

DETAILED DESCRIPTION

Figure 1:
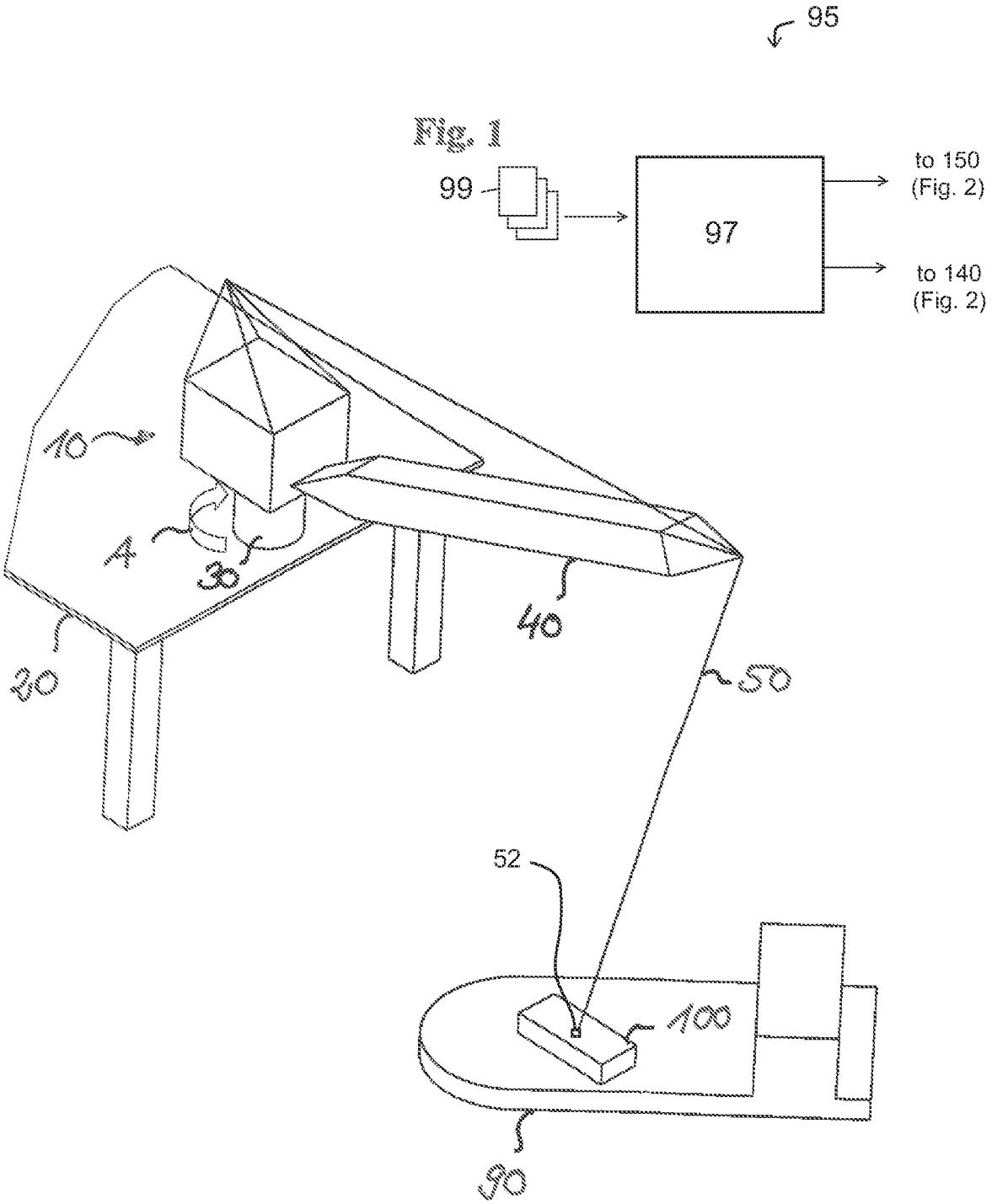
FIG. 1 shows a schematic representation of an offshore crane installed on an offshore platform having an overload safety device in accordance with an embodiment of the present disclosure.

The crane 10 drawn in FIG. 1 is rotatably supported about a vertical axis A on an offshore platform 20 by a slewing gear 30. It has a boom 40 which can be luffed about a horizontal luffing axis and over whose tip a hoist rope 50 runs off, which serves to take up a load 100 supported on a ship 90. The hoist rope 50 can be paid out and drawn in by a hoist winch.

The crane 10 shown is equipped with an overload safety device which is intended to avoid danger to the boom 40 of the crane 10 on a variation in the load torque and to protect the total crane structure from damage. The overload safety device for this purpose includes a control device which is connected to a load hook position detection device which, on the one hand, detects the respective load acting on the crane 10 and, on the other hand, detects the respective position of the load hook or of the suspended load 100.

Furthermore, the overload safety device includes an outreach sensor which detects the outreach of the crane 10, i.e. the horizontal distance of the hoist rope 50 running off the tip of the boom 40 from the vertical axis of rotation A of the crane 10 and communicates it to the control unit of the overload safety device.

The torque at the slewing gear 30 should be limited by the overload safety device in accordance with the present disclosure to prevent potential damage to the boom 40. For example, the oblique pull of the hoist rope 50 caused by an unforeseen movement of the ship 90 can result in an unpermitted load torque on the crane structure, in particular on the slewing gear 30. A relief of the crane structure should now be achieved in accordance with the present disclosure by a situation-dependent adjustment of the holding torque applied by the slewing gear drive to allow a rotary movement of the crane 10 about the vertically standing axis of rotation A in the case of overload. The maximum permitted torque on the slewing gear 30 is in this respect dependent on the outreach or on the position of the crane hook at the hoist rope 50. A crane hook 52 may be located at the end of hoist rope 50 and releasably attachable to load 100.

FIG. 1 illustrates an example overload safety device 95 including a control unit 97 and sensors 99. The control unit may include a processor and memory, including instructions for carrying out the various control actions described herein. Further, the sensors 99 may include the various sensors and/or detection devices described herein, such as a sensor for measuring the outreach and/or the position of the crane hook, as well as a sensor for indicating when the load hook is located below or outside the platform 20. The control unit 97 further sends various control signals as described herein, including a control signal to valve 140 of FIG. 2 for regulating a relief pressure of pressure relief valves and thus the maximum permitted torque on the slewing gear 30 depending on the outreach and/or on the position of the crane hook at the hoist rope 50. For example, one example method carried out by the system of the present disclosure includes, as the ship 90 is moved laterally, thus increasing load on the crane, the control unit can detect this lateral movement at the hook and correspondingly decrease a pressure at the hydraulic motor of the slewing gear (e.g., motor 110) proportionally to the movement, and vice versa. In this way, the holding torque is decreased, enabling the crane to rotate about axis A along with the lateral movement of the ship 90, thereby lowering the stress on the crane structure, without necessarily relying on any letting out of the rope (although such additional action may also be included, if desired). However, such adjustment of the holding torque takes place only when the control unit determines that the resulting load torque is greater than a maximum permitted load torque, again, based on the outreach and/or the position of the crane hook. The maximum permitted load torque may itself vary depending on the position or outreach, with the maximum decreasing the further the outreach from the central rotational axis, for example.

Figure 2:
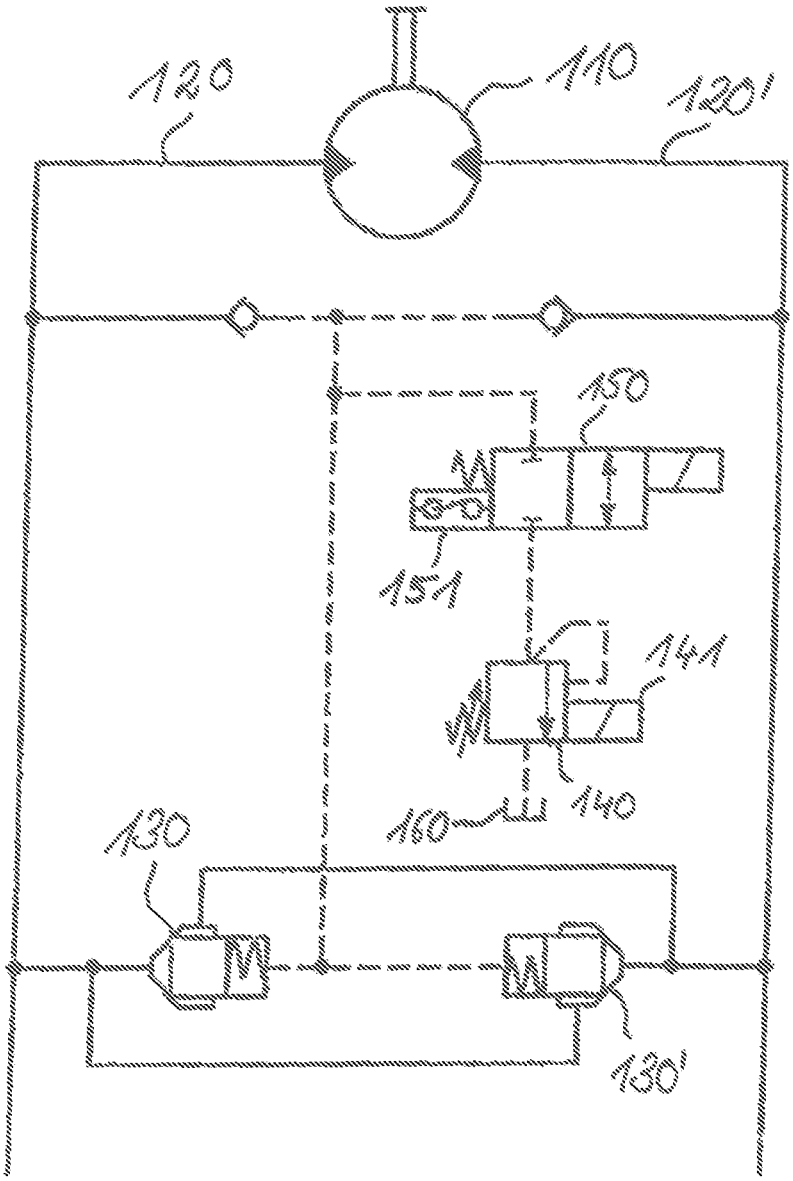
FIG. 2 shows a schematic representation of the circuit of the hydraulic components of the overload safety device of the crane of FIG. 1.

FIG. 2 shows a schematic representation of the circuit for controlling the slewing gear 30 using standardized hydraulic symbols. As can be seen in detail from the Figure, the hydraulic circuit includes the hydraulic motor 110 which is acted on by the desired pressure via the inflow and return flow of the system pressure lines 120, 120' to effect a corresponding rotary movement of the crane 10 about the axis of rotation A via the slewing gear 30. The throughflow direction in this respect determines the direction of rotation of the hydraulic motor 110. Furthermore, a definable holding torque is set via the system pressure lines 120, 120' with which the hydraulic motor 110 holds the slewing gear 30 in position during the crane work. The pressure level in the system pressure lines 120, 120' is as a rule determined via a hydraulic pump, not shown in FIG. 2.

As FIG. 2 further shows, the lead side 120 of the control pressure line of the hydraulic motor 110 is connected to a pressure relief valve 130 which is a so-called pressure cartridge valve in the embodiment shown and is connected at the inlet side to the feed pressure line 120' of the hydraulic motor 110. In addition, a further pressure relief valve 130' is provided which is optionally of identical design and which is in communication at the inlet side with the system pressure line 120 and at the outlet side with the system pressure line 120' of the hydraulic motor 110. In the open state of the two pressure relief valves 130, 130', the supply and the backflow system pressure lines 120, 120' are connected so that pressure oil can flow from the supply side 120 to the backflow side 120' and the hydraulic motor 110 and consequently the slewing gear 30 are rotatable about the axis of rotation A at a predefined resistance.

The opening of the pressure relief valves 130, 130' is controlled hydraulically via a proportional pressure limiting valve 140 which is connected to the hydraulic tank 160 at the inlet side and whose variable outlet pressure determines the applied control pressure at the two pressure relief valves 130, 130'. The proportional pressure limiting valve 140 is in this respect controlled by the control device of the overload safety device in dependence on the outreach of the crane 10 detected by the outreach sensor and on the position of the crane hook determined by the load hook position detection device so that the opening of the two pressure relief valves 130, 130' and thus the system pressure applied to the feed pressure lines 120, 120' are determined in dependence on the crane outreach and on the crane hook position or of the thus respectively permitted limit torque at the slewing gear.

In a further development of the present disclosure, the proportional pressure limiting valve 140 can be regulated by a regulator 141. In this respect, the proportional valve 140 is automatically regulated such that the holding torque measured by the slewing gear drive corresponds to the permitted crane load.

In addition, FIG. 2 shows a 2/2 way valve 150 which is included in the control pressure line between the proportional pressure limiting valve 140 and the two pressure relief valves 130, 130'. This directional valve 150 is designed such that it only has to be energy-loaded for a switched throughflow. An actuation of the two pressure relief valves 130, 130' is only possible at all via the pressure limiting valve 140 in this switching position. In the non-switched state, in contrast, the output line of the pressure limiting valve 140 is blocked, the pressure level in the system pressure lines 120, 120' of the hydraulic motor 110 is consequently only determined by the hydraulic pump, not shown. The function of the overload safety device can consequently be switched on and off comfortably via the directional valve 150.

The on/off valve 150 additionally includes a positional sensor or switch 151 which gives the position of the switch 150 and is controlled by the system so that a defect monitoring is made possible.

The overload safety device can, for example, be deactivated when the load hook is located above the platform 20. On the other hand, the overload safety device can then be activated and the holding torque at the slewing gear 30 can be reduced in dependence on the outreach and on the position of the hook when the load hook is located below or outside the platform 20 in a position which could signify an increased potential danger for the boom system or the crane 10.

The invention claimed is:

1. A crane, comprising:

a slewing gear;

a hydraulic slewing gear drive, wherein the slewing gear is held in position via a holding torque applied by the hydraulic slewing gear drive;

a crane hook; and an overload safety device having at least one detection device for detecting an outreach and/or a position of the crane hook and having at least one pressure relief valve, the overload safety device further comprising a control unit including a processor and non-transitory memory with instructions stored therein for determining the outreach and/or the position of the crane hook with the at least one detection device and adjusting a system pressure applied to the hydraulic slewing gear drive via the at least one pressure relief valve in proportion to the determined outreach and/or the determined position of the crane hook, wherein the outreach is a horizontal distance of a hoist rope running off a tip of a boom of the crane.

2. The crane in accordance with claim 1, wherein in a non-opened state of the at least one pressure relief valve, the holding torque is defined by a pressure setting of a hydraulic pump connected to a system pressure line, and in an open state of the at least one pressure relief valve, a backflow side of the system pressure line is bypassed to the hydraulic slewing gear drive.

3. The crane in accordance with claim 2, wherein a control line of the at least one pressure relief valve is connected to a supply side of the system pressure line of the hydraulic slewing gear drive via at least one check valve, and wherein the control line is further connected to the backflow side of the system pressure line of the hydraulic slewing gear drive via at least one check valve.

4. The crane in accordance with claim 1, wherein the overload safety device has at least one pressure limiting valve, whose outlet pressure is switched as a control pressure to the at least one pressure relief valve.

5. The crane in accordance with claim 4, wherein the instructions stored in the non-transitory memory further comprise instructions for regulating the at least one pressure limiting valve and instructions for regulating the control pressure of the at least one pressure relief valve in proportion to the detected outreach and/or position of the crane hook via the at least one pressure limiting valve.

6. The crane in accordance with claim 1, wherein the hydraulic slewing gear drive has at least one hydraulic motor which applies the holding torque.

7. The crane in accordance with claim 1, wherein the instructions stored in the non-transitory memory further comprise instructions for adjusting the system pressure based on a definable limit holding torque.

8. The crane in accordance with claim 1, wherein at least one pressure relief valve is a pressure cartridge valve.

9. The crane in accordance with claim 1, wherein at least one on/off valve is provided which blocks at least one pressure relief valve in a non-controlled state.

10. The crane in accordance with claim 9, wherein the on/off valve is coupled with at least one switch position sensor, and wherein the crane is rotatably supported about a vertical axis on an offshore platform by the slewing gear.

11. The crane in accordance with claim 1, wherein the crane is rotatably supported about a vertical axis on an offshore platform by the slewing gear, and wherein the overload safety device regulates the system pressure via the pressure relief valve when the crane is vertically outside an area of the offshore platform, and does not regulate the system pressure via the pressure relief valve when the crane is vertically within the area of the offshore platform.

12. A crane, comprising:

a slewing gear;

a hydraulic slewing gear drive, wherein the slewing gear is held in position via a holding torque applied by the hydraulic slewing gear drive;

a crane hook; and an overload safety device having at least one detection device for detecting an outreach and/or a position of the crane hook, at least one pressure cartridge valve, and at least one pressure limiting valve, the overload safety device further comprising a control unit including a processor and non-transitory memory with instructions stored therein for determining the outreach and/or the position of the crane hook with the at least one detection device, adjusting a system pressure applied to the hydraulic slewing gear drive via the at least one pressure cartridge valve in proportion to the determined outreach and/or the determined position of the crane hook, and switching an outlet pressure of the at least one pressure limiting valve as a control pressure to the at least one pressure cartridge valve, wherein the outreach is a horizontal distance of a hoist rope running off a tip of a boom of the crane.

13. The crane in accordance with claim 12, wherein the instructions stored in the non-transitory memory further comprise instructions for regulating the at least one pressure limiting valve and instructions for regulating the control pressure of the at least one pressure cartridge valve in proportion to the detected outreach and/or the detected position of the crane hook via the at least one pressure limiting valve.

14. The crane in accordance with claim 13, wherein a control line of the at least one pressure cartridge valve is connected to a supply side of a system pressure line of the hydraulic slewing gear drive via at least one check valve, and wherein the control line is further connected to a backflow side of the system pressure line of the hydraulic slewing gear drive via at least one check valve.

15. The crane in accordance with claim 14, wherein the hydraulic slewing gear drive has at least one hydraulic motor which applies the holding torque.

16. The crane in accordance with claim 15, wherein the instructions stored in the non-transitory memory further comprise instructions for adjusting the system pressure based on a definable limit holding torque.

17. The crane in accordance with claim 16, wherein at least one on/off valve is provided which blocks at least one pressure cartridge valve in a non-controlled state.

18. The crane in accordance with claim 17, wherein the crane is rotatably supported about a vertical axis on an offshore platform by the slewing gear, and wherein the instructions stored in the non-transitory memory further comprise instructions for determining whether the crane hook is vertically outside an area of the offshore platform, adjusting the system pressure when the crane hook is vertically outside the area of the offshore platform, and not adjusting the system pressure when the crane hook is vertically within the area of the offshore platform.

* * * * *